US007110685B2

(12) United States Patent
Shin

(10) Patent No.: US 7,110,685 B2
(45) Date of Patent: Sep. 19, 2006

(54) TRANSFER POWER SUPPLY APPARATUS OF AN IMAGE FORMING MACHINE

(75) Inventor: Kyu cheol Shin, Gwacheon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 160 days.

(21) Appl. No.: 10/679,317

(22) Filed: Oct. 7, 2003

(65) Prior Publication Data

US 2005/0019049 A1 Jan. 27, 2005

(30) Foreign Application Priority Data

Dec. 17, 2002 (KR) ..... 10-2002-0080913

(51) Int. Cl.
*G03G 15/16* (2006.01)

(52) U.S. Cl. ..... 399/44; 399/66; 399/314

(58) Field of Classification Search ..... 399/44, 399/66, 298, 299, 302, 310, 313, 314
See application file for complete search history.

(56) References Cited

U.S. PATENT DOCUMENTS 5,740,508 A * 4/1998 Matsuura et al. ..... 399/314
6,192,203 B1 * 2/2001 Nishio et al. ..... 399/44
6,766,125 B1 * 7/2004 Izumi ..... 399/66

FOREIGN PATENT DOCUMENTS

JP 2002-72717 3/2002
WO WO 02/69056 A1 9/2002

* cited by examiner

*Primary Examiner*—William J. Royer
(74) *Attorney, Agent, or Firm*—Staas & Halsey LLP

(57) ABSTRACT

A transfer power supply apparatus of an image forming machine which can maintain a predetermined degree of the quality of an image on a print medium even when the temperature of the surrounding environment varies. The image forming machine includes a voltage computation unit computing an appropriate voltage corresponding to resistance of an intermediate transfer medium, an output voltage generator generating a transfer voltage according to a signal output from the voltage computation unit, and a switching unit selectively applying a voltage output from the output voltage generator, wherein the switching unit connects a voltage output from the output voltage generator to a transfer roller when the image created on the intermediate transfer medium is transferred to a print medium, and connects a voltage output from the output voltage generator to a transfer backup roller when the image is not transferred to the print medium.

35 Claims, 4 Drawing Sheets

TRANSFER POWER SUPPLY APPARATUS OF AN IMAGE FORMING MACHINE

CROSS-REFERENCE TO RELATED APPLICATIONS

This application claims the benefit of Korean Application No. 2002-80913, filed Dec. 17, 2002, in the Korean Intellectual Property Office, the disclosure of which is incorporated herein by reference.

BACKGROUND OF THE INVENTION

1. Field of the Invention

The present invention relates to a power supply apparatus for transferring an image in an image forming machine, and more particularly, to a power supply apparatus for transferring an image in an image forming machine for supplying power to a transfer roller and a transfer backup roller for transferring an image which is created on an intermediate transfer medium by a plurality of photoreceptors to a print medium.

2. Description of the Related Art

Generally, one of the typical apparatuses for forming an image on a print medium using an intermediate transfer medium is a single pass color image forming machine. The single pass color image forming machine has a plurality of color image forming units each forming an individual color image on the intermediate transfer medium in a single pass. A color image forming machine creates a predetermined image by precisely overlapping color images transferred from each color image forming unit on the intermediate transfer medium and transfers the created image onto a print medium. Conventionally, the plurality of color image forming units are consecutively arranged in the order of the intermediate transfer medium moving direction respectively developing images in cyan C, magenta M, yellow Y, and black B. The color image forming machine in the present description refers to an apparatus forming a color image on a print medium such as a color printer or a color copier.

An example of an image forming machine for printing an image using such an intermediate transfer medium is shown in FIG. 1.

Referring to FIG. 1, the image forming machine comprises a plurality of color image forming units 10C, 10M, 10Y, 10K, an intermediate transfer medium 30, a transfer device 40, and a transfer power supply apparatus 50.

The plurality of color image forming units 10C, 10M, 10Y, 10K are arranged in the order of the moving direction (shown by the arrow) of the intermediate transfer medium 30 forming images respectively in cyan C, magenta M, yellow Y, and black B. Each color image forming unit 10C, 10M, 10Y, 10K is provided with a photosensitive medium transferring an image onto the intermediate transfer medium 30, a charging roller (not shown) charging the photosensitive medium with a very high voltage, and a development roller (not shown) developing an electrostatic image created on the photosensitive medium in each color. An intermediate transfer roller 20C, 20M, 20Y, 20K is provided for each color image forming unit 10C, 10M, 10Y, 10K having the intermediate transfer medium 30 interposed therebetween for transferring the image created by each color image forming unit 10C, 10M, 10Y, 10K to the intermediate transfer medium 30.

Each color image created by the plurality of color image forming units 10C, 10M, 10Y, 10K is consecutively overlapped on the intermediate transfer medium 30, thereby creating a predetermined color image, and the intermediate transfer medium 30 conveys the color image to the transfer device 40. The intermediate transfer medium 30 is comprised of polyamide, polycarbonate, and urethane which are resilient.

The transfer device 40 comprises a transfer roller 41 and a transfer backup roller 42, for transferring the color image created on the intermediate transfer medium 30 onto a print medium 60 supplied from a feed device (not shown).

The transfer roller 41 allows the image formed on the intermediate transfer medium 30 to be transferred onto the print medium 60 by supplying a constant voltage while pressing the print medium 60 against the intermediate transfer medium 30 by a predetermined pressure. The transfer roller 41, which is a resilient body with a low degree of rigidity, presses the intermediate transfer medium 30 with a low pressure and is electrically formed to be supplied with a high voltage.

The transfer backup roller 42 is comprised of a resilient body with a low degree of rigidity or an electroconductive metal, and supports the intermediate transfer medium 30 pressed by the transfer roller 41. The transfer backup roller 42 is grounded.

The transfer power supply apparatus 50 supplies a predetermined transfer voltage to the transfer roller 41 in order to form an electrostatic field for transferring the image created on the intermediate transfer medium 30 onto the print medium 60. The transfer power supply apparatus 50 comprises a positive power unit supplying positive polarity voltage to the transfer roller 41, a negative power unit supplying negative polarity voltage to the transfer roller 41, and a power shifting member selectively connecting the transfer roller 41 with the positive power unit or the negative power unit. The transfer power supply apparatus 50 controls the power shifting member in order to reverse the polarity of the power supplied to the transfer roller 41 relative to the image during the transfer process when the image on the intermediate transfer medium 30 is being transferred onto the print medium 60 and to once again reverse the polarity during the cleaning process when no image is transferred onto the print medium 60. That is, the transfer power supply apparatus 50 supplies a voltage having the opposite polarity to the polarity of the image created on the intermediate transfer medium 30 for the image to be transferred onto the print medium 60 during the transfer process and supplies the same polarity to that of the polarity of the image created on the intermediate transfer medium 30 so that the image is not transferred to the transfer roller 41 during the cleaning process.

Therefore, visible images created on the photoreceptors of the plurality of color image forming units 10C, 10M, 10Y, 10K through charge, exposure, and development processes are transferred onto the intermediate transfer medium 30 and are precisely overlapped with each other by the electrostatic force formed between the intermediate transfer rollers 20C, 20M, 20Y, 20K and the photoreceptors. The image created on the intermediate transfer medium 30 is transferred again onto the print medium 60 by the transfer roller 41 and the transfer backup roller 42. Since the transfer roller 41 presses against the intermediate transfer medium 30 by a predetermined pressure, and the transfer power supply apparatus 50 supplies a predetermined transfer voltage to the transfer roller 41 transferring development agent to the print medium 60, the development agent such as ink or toner forming an image on the intermediate transfer medium 30 is effectively transferred to the print medium 60.

During the cleaning process when no image is transferred from the intermediate transfer medium 30 to the print medium 60, the transfer power supply apparatus 50 supplies a transfer voltage to the transfer backup roller 42, which is the same transfer voltage transferring the image created on the intermediate transfer medium 30 to the print medium 60. Accordingly, the development agent on the intermediate transfer medium 30 does not contaminate the transfer roller 41 when no image transfer is made to the print medium 60.

However, when the temperature around the image forming machine varies, resistance of the intermediate transfer medium 30 or the transfer roller 41 varies, and when the resistance of the intermediate transfer medium 30 or the transfer roller 41 varies, the output of the transfer power supply apparatus 50 varies. When the output of the transfer power supply apparatus 50 varies, the quantity of the development agent being transferred from the intermediate transfer medium 30 to the print medium 60 varies, thereby causing a problem that the quality of the image transferred onto the print medium 60 varies depending on the surrounding environment. In other words, the conventional transfer power supply apparatus of an image forming machine cannot maintain a predetermined degree of quality of the image transferred onto the print medium regardless of the change in the external environment.

In addition, since the conventional transfer power supply apparatus 50 supplies a necessary voltage by connecting the transfer roller 41 either to the negative power unit or the positive power unit using the power shifting member when switching the mode from the transfer process to the cleaning process or vice versa, the output voltage loaded in the transfer roller 41 largely varies, thereby causing poor quality of the image transferred on the print medium 60 or ineffective cleaning of the intermediate transfer medium 30.

Therefore, there is a need for a transfer power supply apparatus of an image forming apparatus which can maintain the stable quality of the print image by supplying an appropriate voltage to a transfer roller according to the change in the temperature of the surrounding environment during the transfer process, and supplying an appropriate voltage to a transfer backup roller according to the change in the temperature of the surrounding environment during the cleaning process.

SUMMARY OF THE INVENTION

An aspect of the invention is to solve at least the above problems and/or disadvantages and to provide the advantages described hereinafter and/or other aspects and advantages.

Accordingly, one aspect of the present invention is to solve the foregoing problems by providing a transfer power supply apparatus of an image forming machine which can maintain a predetermined degree of the quality of an image on a print medium by minimizing the change in the output of a transfer voltage by supplying an appropriate voltage according to the change in the temperature of the surrounding environment to the transfer roller during the transfer process and to the transfer backup roller during the cleaning process.

The foregoing and/or other aspects and advantages are realized by providing a transfer power supply apparatus of an image forming machine applying a voltage in order to transfer an image created on an intermediate transfer medium onto a print medium conveyed between a transfer roller and a transfer backup roller, the transfer power supply apparatus comprising a voltage computation unit computing a transfer voltage corresponding to resistance of the intermediate transfer medium, an output voltage generator generating the transfer voltage according to the output from the voltage computation unit, and a switching unit selectively applying the transfer voltage output from the output voltage generator, wherein the switching unit connects the transfer voltage output from the output voltage generator to the transfer roller when the image created on the intermediate transfer medium is transferred to the print medium, and connects the transfer voltage output from the output voltage generator to the transfer backup roller when the image is not transferred to the print medium.

The voltage computation unit comprises a transfer electric current recognizer measuring an electric current flowing in the intermediate transfer medium, a resistance computation unit computing resistance of the intermediate transfer medium from the electric current measured in the transfer electric current recognizer, and a voltage determination unit determining the transfer voltage to be output by the resistance calculated from the resistance computation unit.

The voltage determination unit may compute an output voltage according to the resistance using a resistance-voltage table.

The switching unit comprises a grounding unit, a first switching unit disposed to have one point of contact connected to the transfer roller and the other point of contact selectively connected to either the output voltage generator or the grounding unit, and a second switching unit disposed to have one point of contact connected to the transfer backup roller and the other point of contact selectively connected to either the output voltage generator or the grounding unit, wherein the second switching unit is connected to the grounding unit when the first switching device is connected to the output voltage generator. The first switching unit and the second switching unit may be relays.

Another aspect of the present invention is to provide a transfer power supply apparatus of an image forming machine applying a voltage in order to transfer an image created on an intermediate transfer medium onto a print medium conveyed between a transfer roller and a transfer backup roller. The transfer power supply apparatus comprises a first transfer power supply apparatus comprising a first voltage computation unit computing a transfer voltage corresponding to resistance of the intermediate transfer medium, a first output voltage generator outputting the transfer voltage according to the signal output from the first voltage computation unit, and a first switch disposed between the first output voltage generator and the transfer roller, and a second transfer power supply apparatus comprising a second voltage computation unit computing a transfer voltage corresponding to resistance of the intermediate transfer medium, a second output voltage generator outputting the transfer voltage according to the output from the second voltage computation unit, and a second switch disposed between the second output voltage generator and the transfer backup roller. The second switch is turned off, preventing the second transfer power supply apparatus from applying a transfer voltage to the transfer backup roller when the first switch is turned on and the first transfer power supply apparatus supplies a transfer voltage to the transfer roller.

The first and second output voltage generators comprise a transfer electric current recognizer measuring an electric current flowing in the intermediate transfer medium, a resistance computation unit computing resistance of the intermediate transfer medium from an electric current measured from the transfer electric current recognizer, and a voltage determination unit determining the transfer voltage to be output from the resistance computed from the resistance computation unit.

The foregoing and/or other aspects of the present invention are also achieved by an image forming machine comprising an intermediate transfer medium on which images developed in a plurality of developing units are overlapped thereby forming a predetermined color image, a transfer roller transferring a color image created on the intermediate transfer medium onto a print medium, a transfer backup roller supporting the transfer roller, and a transfer power supply apparatus comprising a voltage computation unit computing a transfer voltage corresponding to resistance of the intermediate transfer medium, an output voltage generator outputting the transfer voltage according to the output from the voltage computation unit, and a switching unit applying the transfer voltage output from the output voltage generator selectively to the transfer roller and the transfer backup roller. The transfer power supply apparatus controls the switching unit for a voltage output from the output voltage generator to be connected to the transfer roller when the color image created on the intermediate transfer medium is transferred to the print medium, and to be connected to the transfer backup roller when the color image is not transferred to the print medium.

In addition, the foregoing and/or other aspects of the present invention are achieved by providing an image forming machine comprising an intermediate transfer medium on which images developed in a plurality of developing units are overlapped thereby forming a predetermined color image, a transfer roller transferring a color image created on the intermediate transfer medium onto a print medium, a transfer backup roller supporting the transfer roller, a first transfer power supply apparatus comprising a first voltage computation unit computing a transfer voltage corresponding to resistance of the intermediate transfer medium, a first output voltage generator outputting the transfer voltage according to the output from the first voltage computation unit, and a first switch disposed between the first output voltage generator and the transfer roller, a second transfer power supply apparatus comprising a second voltage computation unit computing transfer voltage corresponding to resistance of the intermediate transfer medium, a second output voltage generator outputting the transfer voltage according to the output from the second voltage computation unit, and a second switch disposed between the second output voltage generator and the transfer backup roller. The second switch is turned off, preventing the second transfer power supply apparatus from applying a transfer voltage to the transfer backup roller when the first switch is turned on and the first transfer power supply apparatus supplies a transfer voltage to the transfer roller.

As described above, according to the transfer power supply apparatus of an image forming machine in accordance to the present invention, a predetermined degree of the quality of an image on a print medium can be maintained by minimizing the change in the output of a transfer voltage by supplying an appropriate voltage according to the change in the temperature of the surrounding to the transfer roller during the transfer process and to the transfer backup roller during the cleaning process.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects of the present invention will be more apparent by describing embodiments of the present invention with reference to the accompanying drawings, in which.

DETAILED DESCRIPTION OF EMBODIMENTS

Figure 1:
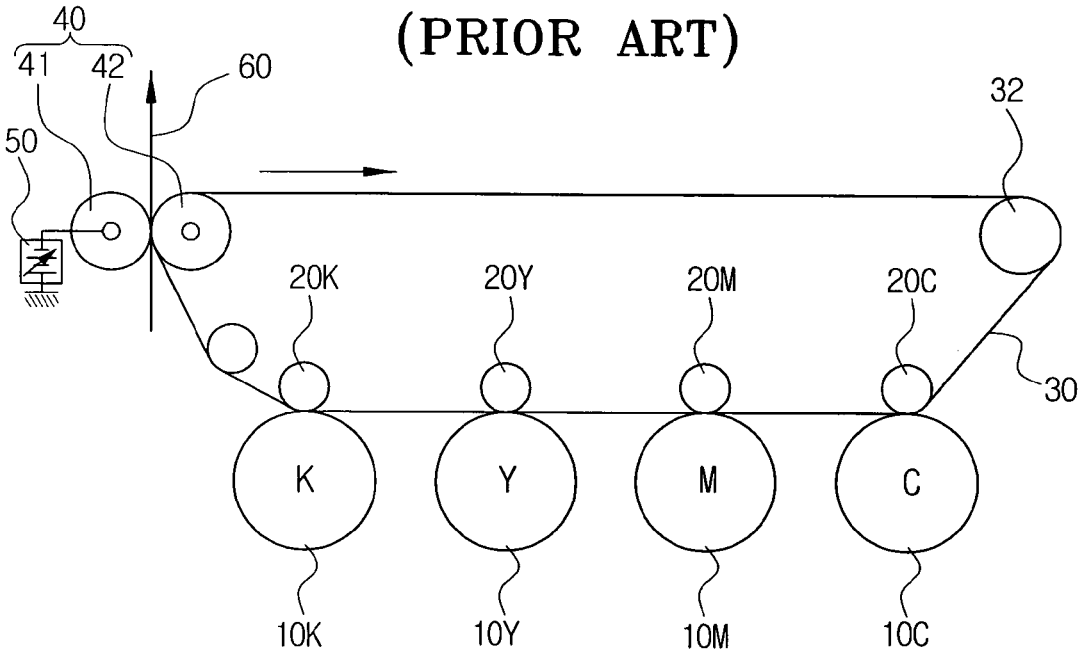
FIG. 1 (PRIOR ART)
FIG. 1 schematically shows an image forming unit of an image forming machine comprising a conventional transfer power supply apparatus.

Hereinafter, a transfer power supply apparatus of an image forming unit according to an embodiment of the present invention will be described in greater detail with reference to the accompanying drawings. Like reference numerals refer to like elements throughout the description and the drawings.

Figure 2:
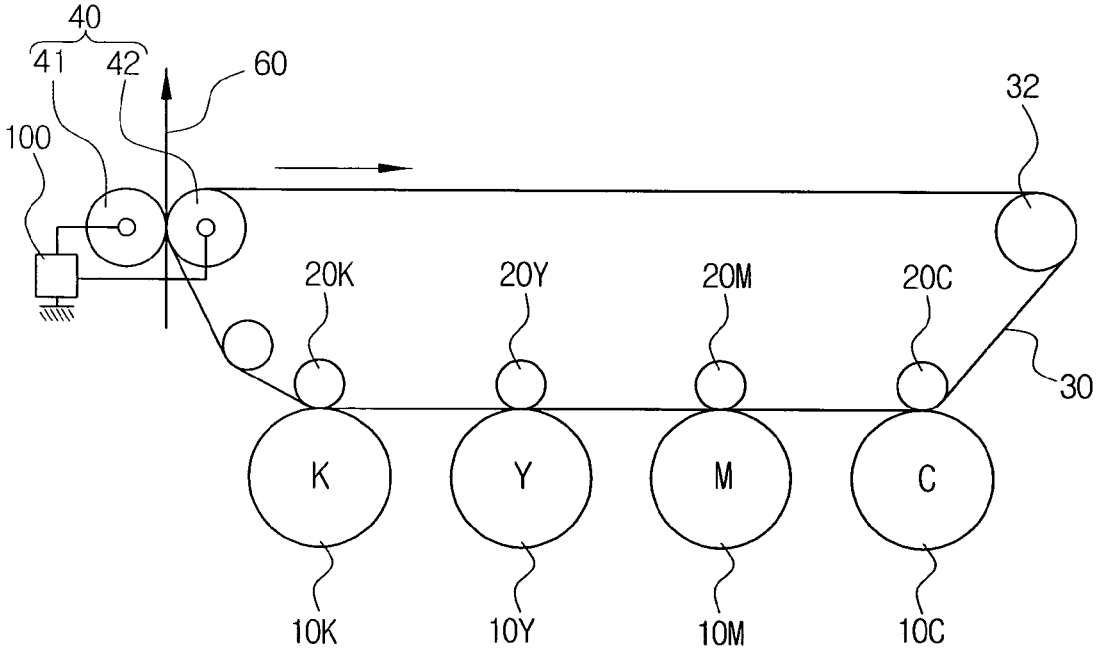
FIG. 2 schematically shows an image forming unit of an image forming machine comprising a transfer power supply apparatus according to an embodiment of the present invention.

FIG. 2 schematically shows an image forming unit forming a predetermined image on a print medium in an image forming machine comprising a transfer power supply.

Referring to FIG. 2, the image forming machine comprises a plurality of color image forming unit 10C, 10M, 10Y, 10K, an intermediate transfer medium 30, a transfer device 40, and a transfer power supply apparatus 100.

The plurality of color image forming units 10C, 10M, 10Y, 10K are arranged in the order of the moving direction (shown by the arrow) of the intermediate transfer medium 30 forming images respectively in cyan C, magenta M, yellow Y, and black B. Each color image forming unit 10C, 10M, 10Y, 10K is provided with a photosensitive medium (photoreceptor) transferring an image onto the intermediate transfer medium 30, a charging roller (not shown) charging the photosensitive medium with a very high voltage, and a development roller (not shown) developing an electrostatic image created on the photosensitive medium in each color. An intermediate transfer roller 20C, 20M, 20Y, 20K is disposed to each color image forming unit 10C, 10M, 10Y, 10K having the intermediate transfer medium 30 interposed therebetween, transferring the image created by each color image forming unit 10C, 10M, 10Y, 10K to the intermediate transfer medium 30.

Each color image created by the plurality of color image forming units 10C, 10M, 10Y, 10K is consecutively transferred onto the intermediate transfer medium 30 to overlap with each other, thereby creating a predetermined color image, and the intermediate transfer medium 30 conveys the color image to the transfer device 40. The intermediate transfer medium 30 is comprised of polyamide, polycarbonate, and urethane which are resilient. A drive roller 32 moves the intermediate transfer medium 30 in the direction shown by the arrow.

The transfer device 40 comprises a transfer roller 41 and a transfer backup roller 42, transferring the color image created on the intermediate transfer medium 30 onto a print medium 60 supplied from a feed device (not shown).

The transfer roller 41 allows the image formed on the intermediate transfer medium 30 to be transferred to the print medium 60 by supplying a constant voltage while pressing the print medium 60 against the intermediate transfer medium 30 with a predetermined pressure. The transfer roller 41, which is a resilient body with a low degree of rigidity, presses the intermediate transfer medium 30 with a low pressure and is electrically formed to be supplied with a high voltage.

The transfer backup roller 42 is comprised of a resilient body with a low degree of rigidity or an electroconductive metal, and supports the intermediate transfer medium 30 pressed by the transfer roller 41. The transfer backup roller 42 is grounded.

Figure 3:
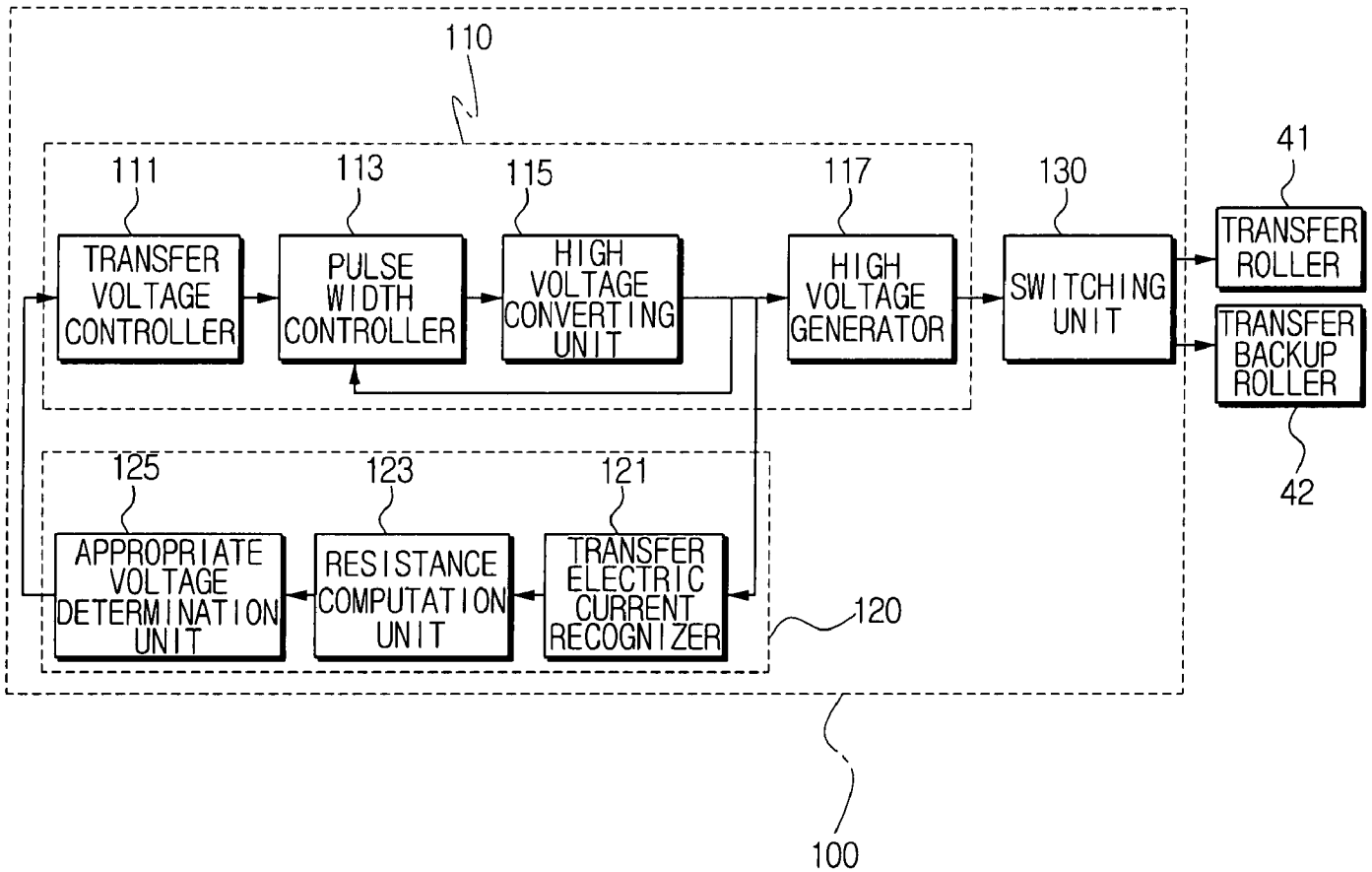
FIG. 3 is a block diagram showing a transfer power supply apparatus of an image forming machine according to the embodiment of the present invention of FIG. 2.

The transfer power supply apparatus 100 supplies a predetermined voltage to the transfer roller 41 and its structure is shown in FIG. 3. Referring to FIG. 3, the transfer power supply apparatus 100 comprises a voltage computation unit 120, an output voltage generator 110, and a switching unit 130.

The voltage computation unit 120 computes an appropriate voltage for transferring an image from the intermediate transfer medium 30, which has a resistance varying according to the change in the surrounding temperature, to the print medium 60. The voltage computation unit 120 comprises a transfer electric current recognizer 121 measuring an electric current flowing in the intermediate transfer medium 30, a resistance computation unit 123 computing resistance of the intermediate transfer medium 30 from the electric current measured from the transfer electric current recognizer 121, and a voltage determination unit 125 determining a voltage to be outputted from the resistance computed from the resistance computation unit 123.

A precise voltage needs to be supplied to the transfer device 40 for maintaining a predetermined degree of image quality transferred onto the print medium 60. Visible images created on photoreceptors of the plurality of color image forming units 10C, 10M, 10Y, 10K through charge, exposure and development processes are transferred on the intermediate transfer medium 30 to overlap with each other by an electrostatic force supplied between the intermediate transfer rollers 20C, 20M, 20Y, 20K and the photoreceptors. The image created on the intermediate transfer medium 30 is conveyed between the transfer roller 41 and the transfer backup roller 42 and transferred onto the print medium 60 by an electrostatic force. The electrostatic force applied to the image on the intermediate transfer medium 30 is determined by the transfer voltage supplied to the transfer roller 41. How effectively the development agent can travel from the intermediate transfer medium 30 to the print medium 60 can be expressed by the following transfer efficiency (η):

$$\eta = \frac{Q_T}{Q_T + Q_R} \times 100\% \qquad \text{Equation 1}$$

where $Q_T$ is the amount of development agent transferred to a print medium, $Q_R$ is the amount of development agent remaining on an intermediate transfer medium, transfer efficiency (η) is the rate of the development agent transferred from the intermediate transfer medium 30 to the print medium 60.

Thus, in order to achieve transfer efficiency, it is necessary to supply an appropriate voltage to the transfer roller 41. That is, if the transfer efficiency is maintained at a stable level, the quality of an image transferred to the print medium 60 can also be maintained at a stable level.

Figure 5:
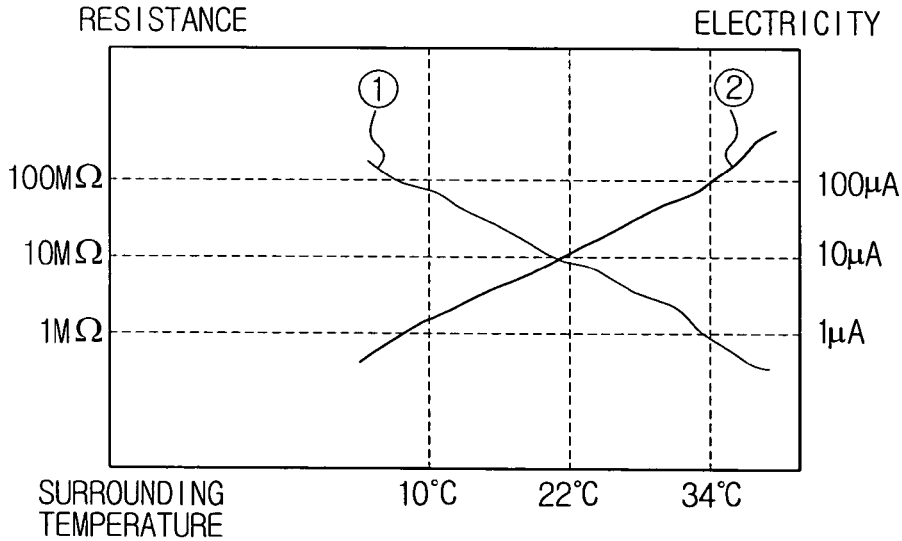
FIG. 5 is a graph showing the change in resistance and a transfer voltage of an intermediate transfer medium according to the change in the temperature of the surrounding environment.

The transfer efficiency should be set so as to transfer the image from the intermediate transfer medium 30 to the print medium 60 at a maximum level and such transfer efficiency is called optimum efficiency. An appropriate voltage to be supplied to the transfer roller 41 to achieve optimum efficiency varies according to the value of resistance of the intermediate transfer medium 30. However, since the resistance value of the intermediate transfer medium 30 varies according to the temperature of the surrounding environment, if the surrounding temperature varies, it becomes difficult to achieve optimum efficiency although a transfer voltage obtaining optimum efficiency at a particular temperature is supplied to the transfer roller 41. In order to maintain optimum efficiency without the influence of the change in the surrounding temperature, it is necessary to change the transfer voltage supplied to the transfer roller 41 according to the resistance value of the intermediate transfer medium 30. Accordingly, the variance in resistance of the intermediate transfer medium 30 according to the temperature should be known and an example of the relationship of temperature and resistance is shown in FIG. 5. Referring to FIG. 5, as the temperature rises, the resistance of the intermediate transfer medium 30 decreases (curve 1), and the electric current increases (curve 2). Therefore, the resistance of the intermediate transfer medium 30 according to the temperature can be known by measuring the electric current flowing in the intermediate transfer medium 30.

The voltage determination unit 125 computes voltage for gaining optimum transfer efficiency according to the resistance of the intermediate transfer medium 30 calculated from the resistance computation unit 123. In one implementation, a predetermined table (resistance-voltage table) showing values of voltage for gaining the optimum transfer efficiency with respect to the resistance of the intermediate transfer medium 30 is established and stored in a storage device (not shown) and a value of voltage corresponding to the resistance calculated in the resistance computation unit 123 in the table is transmitted to the output voltage generator 110.

The output voltage generator 110 outputs transfer voltage according to a signal output from the voltage computation unit 120 and supplies it to the transfer device 40. The output voltage generator 110 comprises a transfer voltage controller 111 outputting a voltage corresponding to the signal input from the voltage computation unit 120, a pulse width controller 113 adjusting and controlling the pulse width for establishing an output voltage at an appropriate output value, a high voltage converting unit 115 converting the output voltage into a high voltage, and a high voltage generator 117 outputting the high output voltage to the transfer device 40.

Figure 4:
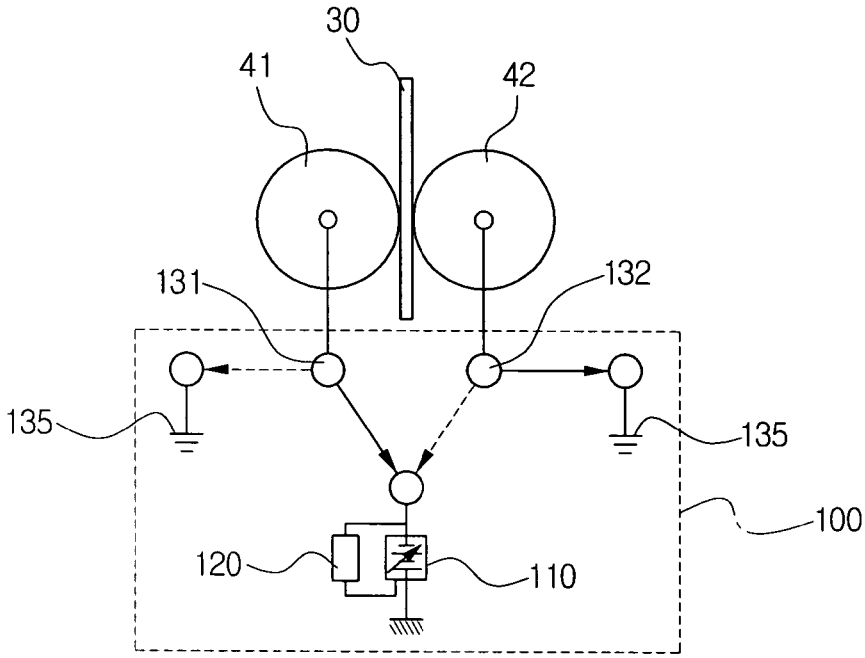
FIG. 4 is a diagram illustrating the operation of the transfer power supply apparatus of FIG. 3.

The switching unit 130 connects the high output voltage output from the output voltage generator 110 either to the transfer roller 41 or the transfer backup roller 42, and comprises a first switching unit 131, a second switching unit 132, and a grounding device 135. (FIG. 4)

The first switching unit 131 is disposed to have one point of contact connected to the transfer roller 41 and the other point of contact selectively connected to the high voltage generator 117 of the output voltage generator 110 or the grounding device 135. The first switching unit 131 may use a relay, a solenoid, or a mechanical contact point shifting device using a motor, which can switch an electrical contact point according to a signal of a control unit (not shown) of an image forming machine.

The second switching unit 132 is disposed to have one point of contact connected to the transfer backup roller 42 and the other point of contact selectively connected to the high voltage generator 117 of the output voltage generator 110 or the grounding device 135. The second switching unit 132 also uses the same contact point shifting device as the first switching unit 131.

If either of the first switching unit 131 or the second switching unit 132 is connected to the output voltage generator 110, the other of the first and second switching units 131, 132 is connected to the grounding device 135. That is, if the first switching unit 131 is connected to the output voltage generator 110 and a high voltage from the output voltage generator 110 is supplied to the transfer roller 41, the second switching unit 132 is connected to the grounding device 135 whereby the high voltage is not supplied to the transfer backup roller 42, and vice versa.

Hereinafter, the operation of transferring an image to a print medium 60 by a transfer power supply apparatus 100 having the above described structure will be described.

When a print command is received, the control unit (not shown) operates the plurality of color image forming units 10C, 10M, 10Y, 10K for developing each color image on each photoreceptor and transferring the developed images onto the intermediate transfer medium 30 to precisely overlap with each other. The image created on the intermediate transfer medium 30 by the plurality of color image forming units 10C, 10M, 10Y, 10K is conveyed to the transfer device 40 together with the intermediate transfer medium 30 moved by the drive roller 32.

When the part of the intermediate transfer medium 30 having the image created enters between the transfer roller 41 and the transfer backup roller 42, a high voltage is supplied to the transfer roller 41, and the transfer backup roller 42 is connected to the grounding device 135. At this time, a voltage having a polarity forming an electrostatic field conveying development agent of a created image from the intermediate transfer medium 30 to the print medium 60 is applied to the transfer roller 41. For example, a positive voltage is applied to the transfer roller 41 when the development agents are negatively charged. Describing the operation of the transfer power supply apparatus 100, one contact point of the first switching unit 131 is connected to the high voltage generator 117 of the output voltage generator 110 and the contact point of the second switching unit 132 is connected to the grounding device 135. Accordingly, the high voltage generated from the output voltage generator 110 is applied to the transfer roller 41. The electric current flowing between the high voltage converting unit 115 and the high voltage generator 117 is measured by the transfer electric current recognizer 121.

During the printing process, if the temperature around the image forming machine varies, the resistance of the intermediate transfer medium 30 varies. Then, the electric current flowing in the high voltage generator 117 varies and therefore the transfer electric current recognizer 121 recognizes the changed value of the electric current. Accordingly, the resistance computation unit 123 computes a value of resistance corresponding to the electric current recognized by the transfer electric current recognizer 121. The voltage determination unit 125 then extracts a value of a voltage corresponding to the value of resistance computed by the resistance computation unit 123 from the resistance-voltage table and transmits the extracted value as an appropriate voltage to the transfer voltage controller 111. The output voltage generator 110 then generates a high voltage corresponding to the appropriate voltage input into the transfer voltage controller 111. That is, the output voltage generator 110 detects the electric current flowing between the high voltage converting unit 115 and the high voltage generator 117 and sends the detected electric current to the pulse width controller 113 for the pulse width controller 113 to generate a voltage corresponding to the appropriate voltage input into the transfer voltage controller 111.

When an image is completely transferred onto a sheet of print medium 60, a high transfer voltage is applied to the transfer backup roller 42 and the transfer roller 41 is connected to the grounding device 135. When a high voltage is applied to the transfer backup roller 42, an electrostatic field drawing development agents is formed between the transfer backup roller 42 and the intermediate transfer medium 30 and therefore the development agents on the intermediate transfer medium 30 are not transferred to the transfer roller 41. Accordingly, the transfer roller 41 can be prevented from being contaminated by the development agents. Describing the operation of the transfer power supply apparatus 100, one contact point of the second switching unit 132 is connected to the high voltage generator 117 of the output voltage generator 110, and the contact point of the first switching unit 131 is connected with the grounding device 135. Thus, the high voltage generated from the output voltage generator 110 is applied to the transfer backup roller 42. The electric current flowing between the high voltage converting unit 115 and the high voltage generator 117 is measured by the transfer electric current recognizer 121. Even when the surrounding temperature changes between the printing processes, i. e., during the cleaning process, the development agents on the intermediate transfer medium 30 are not transferred to the transfer roller 41 since the transfer power supply apparatus 100 detects resistance of the intermediate transfer medium 30 by the transfer electric current recognizer 121 and applies a transfer voltage appropriate for the corresponding temperature to the transfer backup roller 42.

When an image created on the intermediate transfer medium 30 is transferred to a new print medium 60, the switching unit 130 is operated for applying a high transfer voltage to the transfer roller 41 and therefore the transfer backup roller 42 is connected to the grounding device 135.

As described above, a transfer voltage is applied to the transfer roller 41 and transfer backup roller 42 using a single transfer power supply apparatus 100 having a switching unit 130. An embodiment of the present invention in which a separate transfer power supply apparatus is connected to the transfer roller 41 and the transfer backup roller 42 respectively as shown in FIG. 6 is illustrated below.

Figure 6:
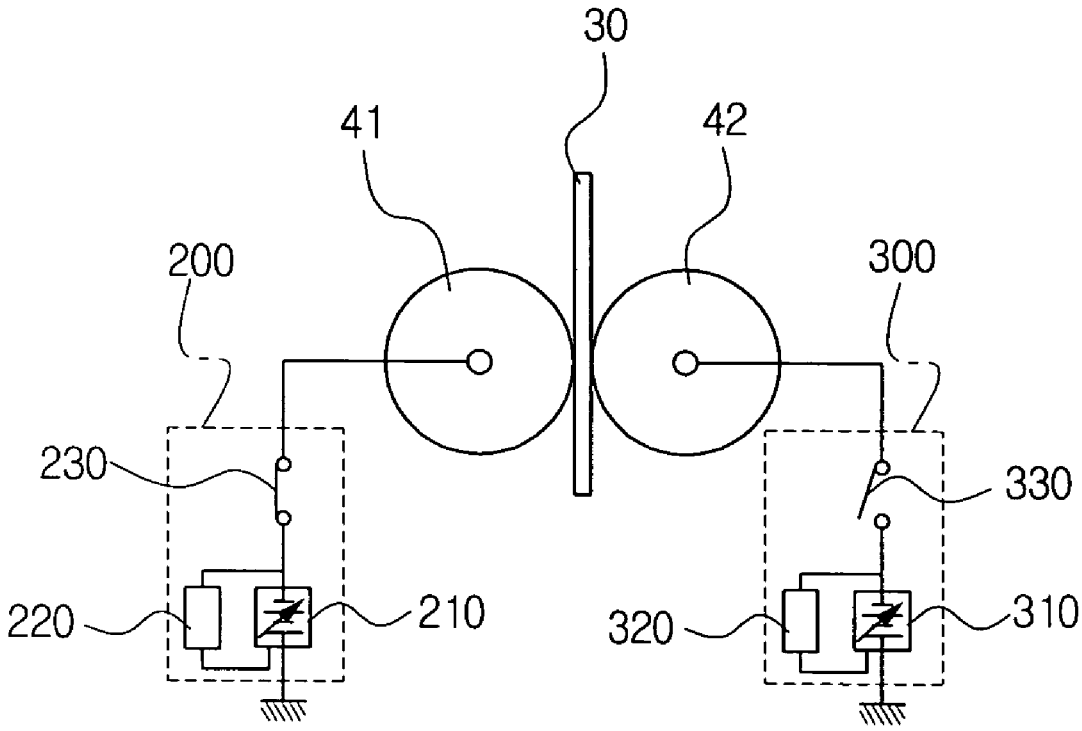
FIG. 6 shows a transfer power supply apparatus of an image forming machine according to another embodiment of the present invention.

Referring to FIG. 6, a first transfer power supply apparatus 200 is connected to the transfer roller 41 and a second transfer power supply apparatus 300 is connected to the transfer backup roller 42.

The first transfer power supply apparatus 200 comprises a first voltage computation unit 220, a first output voltage generator 210, and a first switch 230, and the second transfer power supply apparatus 300 comprises a second voltage computation unit 320, a second output voltage generator 310, and a second switch 330.The first and second voltage computation units 220, 320, and the first and second output voltage generators 210, 310 are identical to the voltage computation unit 120 and the output voltage generator 110 in the above described embodiment and therefore will not be described again.

The first switch 230 is disposed between the transfer roller 41 and the first output voltage generator 210, and turned on for a high voltage to be applied to the transfer roller 41 when the image on the intermediate transfer medium 30 is transferred to the print medium 60. When the image is completely transferred to the print medium 60,the first switch 230 is turned off.

The second switch 330 is disposed between the transfer backup roller 42 and the second output voltage generator 310. The second switch 330 stays off when an image on the intermediate transfer medium 30 is transferred to the print medium 60, and is turned on for a high voltage to be applied to the transfer backup roller 42 during the cleaning process.

The control unit (not shown) of an image forming machine has the first switch 230 turned on, allowing a high voltage to be applied to the transfer roller 41, and the second switch 330 turned off, preventing a voltage from being applied to the transfer backup roller 42 during the transferring process. During the cleaning process, the second switch 330 is turned on, applying a voltage to the transfer backup roller 42, and the first switch 230 is turned off, preventing a voltage from being applied to the transfer roller 41.

The image forming machine comprising a transfer power supply apparatus according to the present invention described above may obtain an optimum transfer efficiency at all times since an appropriate transfer voltage is applied to the transfer roller based on the resistance of the intermediate transfer medium. In addition, because the polarity of the transfer voltage applied to the transfer roller or the transfer backup roller during the transfer process and the cleaning process is the same, there is no occurrence of change in an output voltage according to the change in polarity.

In the above, a case in which an image created on an intermediate transfer medium is transferred onto a print medium when a transfer voltage is applied to a transfer roller has been described. However, when the voltage of the opposite polarity is used, the same transfer power supply apparatus according to the present invention may be applied as the image created on the intermediate transfer medium is conveyed to the print medium when a transfer voltage is supplied to the transfer backup roller.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A transfer power supply apparatus of an image forming machine applying a voltage in order to transfer an image created on an intermediate transfer medium onto a print medium conveyed between a transfer roller and a transfer backup roller, the transfer power supply apparatus comprising:

a voltage computation unit computing a transfer voltage corresponding to resistance of the intermediate transfer medium;

an output voltage generator generating the transfer voltage according to the output from the voltage computation unit; and a switching unit selectively applying the transfer voltage output from the output voltage generator, wherein the switching unit connects the transfer voltage output from the output voltage generator to the transfer roller when the image created on the intermediate transfer medium is transferred to the print medium, and connects the transfer voltage output from the output voltage generator to the transfer backup roller when the image is not transferred to the print medium.

2. The transfer power supply apparatus according to claim 1, wherein the voltage computation unit comprises:

a transfer electric current recognizer measuring an electric current flowing in the intermediate transfer medium;

a resistance computation unit computing resistance of the intermediate transfer medium from the electric current measured in the transfer electric current recognizer; and a voltage determination unit determining the transfer voltage to be output from the resistance computed by the resistance computation unit.

3. The transfer power supply apparatus according to claim 2, wherein the voltage determination unit computes the transfer voltage according to the resistance using a resistance-voltage table.

4. The transfer power supply apparatus according to claim 1, wherein the switching unit comprises:

a grounding device;

a first switching unit disposed to have a first point of contact connected to the transfer roller and a second point of contact selectively connected to either the output voltage generator or the grounding device; and a second switching unit disposed to have a first point of contact connected to the transfer backup roller and a second point of contact selectively connected to either the output voltage generator or the grounding device, wherein the second switching unit is connected to the grounding device when the first switching unit is connected to the output voltage generator.

5. The transfer power supply apparatus according to claim 4, wherein the first switching unit and the second switching unit comprise relays.

6. A transfer power supply apparatus of an image forming machine applying a voltage in order to transfer an image created on an intermediate transfer medium onto a print medium conveyed between a transfer roller and a transfer backup roller, the transfer power supply apparatus comprising:

a first transfer supply apparatus comprising, a first voltage computation unit computing a transfer voltage corresponding to resistance of the intermediate transfer medium, a first output voltage generator outputting the transfer voltage according to the output from the first voltage computation unit, and a first switch disposed between the first output voltage generator and the transfer roller; and a second transfer power supply apparatus comprising, a second voltage computation unit computing a transfer voltage corresponding to resistance of the intermediate transfer medium, a second output voltage generator outputting the transfer voltage according to a signal output from the second voltage computation unit, and a second switch disposed between the second output voltage generator and the transfer backup roller, wherein the second switch is turned off to prevent the second transfer power supply apparatus from applying the corresponding transfer voltage to the transfer backup roller when the first switch is turned on and the first transfer power supply apparatus supplies the corresponding transfer voltage to the transfer roller.

7. The transfer power supply apparatus according to claim 6, wherein the first and second voltage computation units comprise:

a transfer electric current recognizer measuring an electric current flowing in the intermediate transfer medium;

a resistance computation unit computing resistance of the intermediate transfer medium from the electric current measured from the transfer electric current recognizer; and a voltage determination unit determining the transfer voltage to be output from the resistance computation by the resistance computing unit.

8. The transfer power supply apparatus according to claim 7, wherein the voltage determination unit determines the transfer voltage according to the resistance using a resistance-voltage table.

9. An image forming machine comprising:

an intermediate transfer medium on which images developed by a plurality of developing units are overlapped thereby forming a predetermined color image;

a transfer roller transferring the color image created on the intermediate transfer medium onto a print medium;

a transfer backup roller supporting the transfer roller; and a transfer power supply apparatus comprising, a voltage computation unit computing a transfer voltage corresponding to the resistance of the intermediate transfer medium, an output voltage generator outputting the transfer voltage according to the output from the voltage computation unit, and a switching unit applying the transfer voltage output from the output voltage generator selectively to the transfer roller and the transfer backup roller;

wherein the transfer power supply apparatus controls the switching unit to connect the transfer voltage output from the output voltage generator to the transfer roller when the color image created on the intermediate transfer medium is transferred to the print medium, and to connect the voltage output from the output voltage generator to the transfer backup roller when the color image is not transferred to the print medium.

10. The image forming machine according to claim 9, wherein the voltage computation unit comprises:

a transfer electric current recognizer measuring an electric current flowing in the intermediate transfer medium;

a resistance computation unit computing the resistance of the intermediate transfer medium from the electric current measured from the transfer electric current recognizer; and a voltage determination unit determining the transfer voltage to output from the resistance computation by the resistance computing unit.

11. The image forming machine according to claim 9, comprising:

a grounding device;

a first switching unit disposed to have one point of contact connected to the transfer roller and the other point of contact selectively connected to either the output voltage generator or the grounding device; and a second switching unit disposed to have one point of contact connected to the transfer backup roller and the other point of contact selectively connected to either the output voltage generator or the grounding device;

wherein the second switching unit is connected to the grounding device when the first switching unit is connected to the output voltage generator.

12. An image forming machine comprising:

an intermediate transfer medium on which images developed by a plurality of developing units are overlapped thereby forming a predetermined color image;

a transfer roller transferring a color image created on the intermediate transfer medium onto a print medium;

a transfer backup roller supporting the transfer roller;

a first transfer power supply apparatus comprising:

a first voltage computation unit computing a transfer voltage corresponding to resistance of the intermediate transfer medium, a first output voltage generator outputting the transfer voltage according to the output from the first voltage computation unit, and a first switch disposed between the first output voltage generator and the transfer roller; and a second transfer power supply apparatus comprising:

a second voltage computation unit computing a transfer voltage corresponding to the resistance of the intermediate transfer medium, a second output voltage generator outputting the transfer voltage according to the output from the second voltage computation unit, and a second switch disposed between the second output voltage generator and the transfer backup roller;

wherein the second switch is turned off to prevent the second transfer power supply apparatus from applying the corresponding transfer voltage to the transfer backup roller when the first switch is turned on and the first transfer power supply apparatus supplies the corresponding transfer voltage to the transfer roller.

13. The image forming machine according to claim 12, wherein the first and second voltage computation units comprise:

a transfer electric current recognizer measuring an electric current flowing in the intermediate transfer medium;

a resistance computation unit computing the resistance of the intermediate transfer medium from the electric current measured from the transfer electric current recognizer; and a voltage determination unit determining the transfer voltage to be output from resistance computation by the resistance computing unit.

14. The image forming machine of claim 12, wherein each of the first and second output voltage generators comprise:

a transfer voltage controller outputting a voltage corresponding to the signal input from the first and second voltage computation units, respectively;

a pulse width controller adjusting and controlling a pulse width establishing an output voltage at an appropriate output value;

a high voltage converting unit converting the output voltage into a high voltage; and a high voltage generator outputting a high output voltage comprising the transfer voltage.

15. The image forming machine of claim 12, the developing units comprising:

color image forming units each provided with a photosensitive medium transferring an image onto the intermediate transfer medium;

a charging roller charging the photosensitive medium with a very high voltage; and a development roller developing an electrostatic image created on the photosensitive medium in each color.

16. The image forming machine of claim 15, further comprising:

an intermediate transfer roller for each of the color image forming units, the intermediate transfer medium interposed between the color image forming units and each corresponding intermediate transfer roller to transfer the image created on each of the color image forming units to the intermediate transfer medium.

17. The image forming machine of claim 12, wherein the transfer roller comprises a resilient body with a low degree of rigidity.

18. The image forming machine of claim 12, wherein the transfer backup roller comprises an electroconductive metal.

19. The image forming machine of claim 12, wherein the intermediate transfer medium is comprised of at least one of a polyamide, a polycarbonate, and a urethane resilient material.

20. The image forming machine of claim 12, further comprising:

a drive roller that moves the intermediate transfer medium between the transfer roller and the transfer backup roller.

21. The image forming machine of claim 12, wherein the first switch comprises a first point of contact connected to the transfer roller and a second point of contact selectively connected to the first output voltage generator or a grounding device.

22. The image forming machine of claim 12, further comprising:

a control unit that controls operation of the image forming machine;

wherein the first switch comprises a mechanical contact point shifting device using a motor that switches an electrical contact point according to a signal from the control unit.

23. The image forming machine of claim 12, wherein the first switch comprises a relay.

24. The image forming machine of claim 12, wherein the first switch comprises a solenoid.

25. The image forming machine of claim 12, wherein the second switch comprises a first point of contact connected to the transfer backup roller and a second point of contact selectively connected to the second output voltage generator or a grounding device.

26. A method of maintaining a constant transfer voltage from a power supply circuit to transfer an image from an intermediate transfer medium having a temperature-sensitive resistance value to a print medium, comprising:

measuring a change in the resistance value of the intermediate transfer medium according to a change in a temperature of a surrounding environment;

adjusting an output from the power supply circuit according to the change in the resistance value to thereby maintain the constant transfer voltage.

27. The method of claim 26, further comprising:

switching the constant transfer voltage to a transfer backup roller during a cleaning process.

28. A transfer power supply apparatus of an image forming machine applying a voltage in order to transfer an image created on an intermediate transfer medium onto a print medium conveyed between a transfer roller and a transfer backup roller, the transfer power supply apparatus comprising:

a voltage computation unit computing a voltage level corresponding to a resistance of the intermediate transfer medium; and an output voltage generator generating a transfer voltage according to a signal output from the voltage computation unit.

29. The apparatus of claim 28, wherein the voltage computation unit comprises:

a transfer electric current recognizer measuring an electric current flowing in the intermediate transfer medium;

a resistance computation unit computing the resistance of the intermediate transfer medium from the measured electric current; and a voltage determination unit determining the voltage level according to the resistance calculated by the resistance computation unit.

30. A printer comprising:

an intermediate transfer medium on which an image is formed and having a varying resistance according to a change in temperature;

a transfer roller facilitating a transfer of the image from the intermediate transfer medium onto a print medium using a voltage applied to the transfer roller; and a power supply unit providing the voltage to the transfer roller at a voltage level based on the resistance of the intermediate transfer medium.

31. A method of printing with an apparatus that comprises an intermediate transfer medium on which images developed by a plurality of developing units are overlapped thereby forming a predetermined color image, a transfer roller transferring a color image created on the intermediate transfer medium onto a print medium, and a transfer backup roller supporting the transfer roller, the method comprising:

applying a voltage to the transfer roller;

measuring a current in the intermediate transfer medium while the voltage is applied;

computing a resistance value of the intermediate transfer medium based on the measured current;

adjusting the applied voltage according to the computed resistance value; and conveying a development agent of a created image from the intermediate transfer medium to a print medium as a result of an electrostatic field from the applied voltage.

32. The method of claim 31, further comprising:

receiving a print command; and wherein the applying of the voltage occurs upon receipt of the print command.

33. The method of claim 31, wherein the applying of the voltage comprises connecting a high voltage to the transfer roller and a ground potential to the transfer backup roller thereby forming an electrostatic field.

34. The method of claim 31, wherein the adjusting of the applied voltage according to the computed resistance value comprises:

extracting a value of a voltage corresponding to the resistance value from a resistance-voltage table;

wherein the adjusting the applied voltage comprises adjusting of the applied voltage according to the extracted value of the voltage.

35. The method of claim 31, further comprising:

receiving a print stop command when the image is completely transferred onto the print medium; and reversing a polarity of the transfer backup roller and the transfer roller to stop printing.

* * * * *